US009132321B2

(12) United States Patent
Bothwell

(10) Patent No.: US 9,132,321 B2
(45) Date of Patent: Sep. 15, 2015

(54) SYSTEM AND METHOD FOR AN INFLATION BLADDER COMPOSITE GAME RACKET

(76) Inventor: Brett Bothwell, New York, NY (US)

( * ) Notice: Subject to any disclaimer, the term of this patent is extended or adjusted under 35 U.S.C. 154(b) by 891 days.

(21) Appl. No.: 13/243,346

(22) Filed: Sep. 23, 2011

(65) Prior Publication Data

US 2012/0077630 A1 Mar. 29, 2012

Related U.S. Application Data

(63) Continuation-in-part of application No. 13/046,723, filed on Mar. 12, 2011, now abandoned, which is a continuation-in-part of application No. 12/072,030, filed on Feb. 21, 2008, now Pat. No. 7,938,747, and a continuation-in-part of application No. 11/986,828, filed on Nov. 26, 2007, now Pat. No. 7,927,239.

(51) Int. Cl.
*A63B 49/02* (2015.01)
*A63B 49/00* (2015.01)
(Continued)

(52) U.S. Cl.
CPC ..... *A63B 49/002* (2013.01); *A63B 49/007* (2013.01); *A63B 49/106* (2013.01); *A63B 51/00* (2013.01); *A63B 49/14* (2013.01); *A63B 51/12* (2013.01); *A63B 59/0074* (2013.01);
(Continued)

(58) Field of Classification Search
CPC ..... A63B 49/00; A63B 49/02; A63B 49/027; A63B 49/10; A63B 2049/103; A63B 49/106; A63B 49/002; A63B 49/007; A63B 49/14; A63B 51/00; A63B 51/12; A63B 59/0074; A63B 2209/00; A63B 2209/023
USPC ..... 473/524, 535, 536, 539
See application file for complete search history.

(56) References Cited

U.S. PATENT DOCUMENTS 360,468 A 4/1887 Phelps
1,558,507 A 10/1925 Ryder
(Continued)

FOREIGN PATENT DOCUMENTS

DE 2611970 9/1977
DE 2225595 3/1980
(Continued)

OTHER PUBLICATIONS

Patent Publication 2009/0137351 Bothwell Published on May 28, 2009.
(Continued)

*Primary Examiner* — Raleigh W Chiu
(74) *Attorney, Agent, or Firm* — Lisa Foundation Patent Law Clinic at Arizona State University

(57) ABSTRACT

A system and methods for creating a strong game racket using multiple inflation bladders. A strong game racket frame comprising a handle, a throat member coupled to the handle, a bridge portion coupled to the throat member and a head frame couple to the throat member. A method for creating a strong game racket comprising the acts of placing a pre-preg first bladder into a mold cavity shaped like a racket frame, placing various pre-formed members and/or secondary mold members into the cavity, and placing a second and/or third pre-preg bladder into the mold cavity above the first bladder and any pre-formed members and/or secondary mold members. After the mold is configured it is closed, pressurized, and heated so that the strong composite game racket can be cured.

19 Claims, 9 Drawing Sheets

(51) Int. Cl.

| | |
|---|---|
| ***A63B 49/10*** | (2015.01) |
| ***A63B 51/00*** | (2015.01) |
| *A63B 49/14* | (2015.01) |
| *A63B 51/12* | (2006.01) |
| *A63B 59/00* | (2015.01) |

(52) U.S. Cl.
CPC ..... *A63B2209/00* (2013.01); *A63B 2209/023* (2013.01); *A63B 2209/08* (2013.01)

(56) References Cited

U.S. PATENT DOCUMENTS

| | | | | |
|---|---|---|---|---|
| 2,034,444 | A | | 3/1936 | Smolik et al. |
| 3,874,667 | A | | 4/1975 | Gallagher et al. |
| 3,884,467 | A | | 5/1975 | Sommer et al. |
| 3,904,202 | A | | 9/1975 | DeLorean |
| 3,999,756 | A | | 12/1976 | Head |
| 4,005,862 | A | | 2/1977 | Portz et al. |
| 4,165,071 | A | | 8/1979 | Frolow |
| 4,206,917 | A | | 6/1980 | Guillem et al. |
| 4,441,712 | A | | 4/1984 | Guthke |
| 4,512,576 | A | | 4/1985 | Dahlgren |
| 4,566,695 | A | | 1/1986 | Melby |
| 4,613,138 | A | | 9/1986 | Haythornthwaite |
| 4,681,319 | A | | 7/1987 | Zilinskas |
| 4,765,620 | A | | 8/1988 | Janes |
| 4,772,021 | A | | 9/1988 | Maynard |
| 4,786,055 | A | | 11/1988 | Darling |
| 4,909,511 | A | | 3/1990 | Deville et al. |
| 4,983,242 | A | | 1/1991 | Reed |
| 4,995,608 | A | | 2/1991 | von Hackewitz |
| 5,029,859 | A | | 7/1991 | Davis |
| 5,054,779 | A | | 10/1991 | Marrello |
| 5,083,776 | A | | 1/1992 | Liu |
| 5,102,132 | A | | 4/1992 | Chen |
| 5,137,769 | A | | 8/1992 | Landi |
| 5,141,228 | A | | 8/1992 | Soong |
| 5,165,687 | A | | 11/1992 | Soong |
| 5,184,818 | A | * | 2/1993 | Lo ..... 473/545 |
| 5,197,732 | A | | 3/1993 | Lanctot |
| 5,217,223 | A | * | 6/1993 | Feeney ..... 473/535 |
| RE34,420 | E | | 10/1993 | Darling |
| 5,251,895 | A | | 10/1993 | Darling |
| 5,332,213 | A | | 7/1994 | Klose |
| 5,358,261 | A | * | 10/1994 | Cheng ..... 473/537 |
| 5,368,297 | A | | 11/1994 | Liu |
| 5,419,963 | A | | 5/1995 | Kuebler |
| 5,458,331 | A | | 10/1995 | Bothwell |
| 5,460,370 | A | * | 10/1995 | Tung-Han ..... 473/545 |
| 5,516,100 | A | * | 5/1996 | Natsume ..... 473/535 |
| 5,538,243 | A | | 7/1996 | Yamamoto et al. |
| 5,613,916 | A | | 3/1997 | Sommer |
| 5,642,881 | A | * | 7/1997 | Stennett ..... 473/537 |
| 5,762,570 | A | | 6/1998 | Shaw |
| 5,944,625 | A | | 8/1999 | Janes |
| 6,071,203 | A | | 6/2000 | Janes et al. |
| 6,503,161 | B2 | | 1/2003 | Bothwell |
| 6,506,134 | B2 | | 1/2003 | Bertolotti |
| 6,530,851 | B2 | | 3/2003 | Munster |
| 6,800,239 | B2 | | 10/2004 | Davis |
| 6,971,964 | B1 | | 12/2005 | Bothwell |
| 7,077,768 | B2 | * | 7/2006 | Filippini ..... 473/535 |
| 7,104,905 | B2 | | 9/2006 | Scwenger et al. |
| 7,396,303 | B2 | | 7/2008 | Gazzara et al. |
| 7,938,747 | B2 | | 5/2011 | Bothwell |
| 2001/0023210 | A1 | * | 9/2001 | Munster ..... 473/524 |
| 2002/0039937 | A1 | | 4/2002 | Bothwell |
| 2009/0137351 | A1 | | 5/2009 | Bothwell |
| 2009/0215558 | A1 | | 8/2009 | Bothwell |
| 2011/0165975 | A1 | * | 7/2011 | Bothwell ..... 473/535 |
| 2012/0077630 | A1 | * | 3/2012 | Bothwell ..... 473/539 |

FOREIGN PATENT DOCUMENTS

| | | |
|---|---|---|
| DE | 3740765 | 6/1989 |
| EP | 060170 | 1/1994 |
| EP | 0803271 | 10/1997 |
| FR | 1059989 | 11/1953 |
| FR | 2587227 | 3/1987 |
| WO | 9847574 | 10/1998 |
| WO | WO 9847574 | 10/1998 |
| WO | WO9847574 | 10/1998 |

OTHER PUBLICATIONS

Patent Publication 2011/0165975 Bothwell Published on Jul. 7, 2011.
U.S. Appl. No. 13/046,723, filed Jul. 2011, Bothwell.

* cited by examiner

SYSTEM AND METHOD FOR AN INFLATION BLADDER COMPOSITE GAME RACKET

CROSS REFERENCE TO RELATED APPLICATION

This application is a continuation-in-part of U.S. application Ser. No. 13/046,723 entitled 'System and Method for a Pre-Formed Reinforcement Member for an Opening in a Game Racket' to Brett Bothwell filed on Mar. 12, 2011, which is a continuation in part of and claims priority to both U.S. application Ser. No. 12/072,030 entitled "Game Racket Including Pivot Element" to Brett Bothwell filed on Feb. 21, 2008 and U.S. application Ser. No. 11/986,828 entitled "Substantially Fluid Tight Game Racket Including A Spring Suspension Module" to Brett Bothwell filed on Nov. 26, 2007, the disclosures of which are herein incorporated by reference in their entirety.

BACKGROUND OF THE INVENTION

1. Field of the invention

Various aspects of the present invention relate to game rackets used for striking an object. Specifically in some implementations, game rackets and inflation bladder methods for making said game rackets, such that the game rackets are stronger, lighter, and more useful in general than conventional game rackets.

2. Description of Related Art

Conventional composite racket frames made by the inflation bladder molding method are typically made with a single bladder surrounded by composite pre-preg material, then placed in a mold cavity for final formation. This relatively simple process has become the industry standard. A racket made by this method, while lightweight and strong, does have sonic drawbacks. The hollow frame leads to a profile that is unstable due to torsion. In addition, the frame lacks compressive strength along the axis of the string-bed plane, i.e. a hollow racket frame can be designed to resist bending due to use, but its compressive resistance to forces such string tension and impact shock is inherently limited. This type of frame also typically requires drilling of string holes in a straight line around the head frame after molding, resulting in an even weaker frame.

U.S. Pat. Nos. 6,071,203 and 6,800,239 concern molding techniques that utilize two bladders wrapped with pre-preg material to make one complete unitary racket profile. In these rackets, string holes can be pre-formed in the racket fabrication process, thus eliminating the need for drilling; string hole openings may also be "ports," with a bearing structure that strengthens the frame. In addition, the continuous internal wall of the frame profile increases overall strength. Frames developed by this method, however, are not without significant drawbacks. Pre-formed string holes or ports are labor intensive and require human intervention to achieve the design.

This limitation was addressed in U.S. Pat. No. 7,396,303, where applicants replaced preformed string holes with "cutouts" or elongated openings with a separately made plastic bearing for the strings. This design does reduce the labor required, but also compromises the torsional stability and compressive strength of the frame profile—thus significantly weakening the frame. To compensate, the frame is then in need of a stabilizing mechanism.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 6,071,203

U.S. Pat. No. 6,800,239

U.S. Pat. No. 7,396,303

U.S. application Ser. No. 13046723

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant(s) will amend the specification to expressly recite the essential material that is incorporated by reference as allowed by the applicable rules.

BRIEF SUMMARY OF THE INVENTION

The present invention provides among other things an improved composite game racket frame and an adaptation of the inflation bladder molding method for making such a racket. More specifically, the present invention provides a game racket frame with improved strength. In addition, embodiments of the present invention provide various options for how the string-bed penetrates the head frame and bridge profiles.

The invention may further provide a game racket frame that can have drilled string holes without sacrificing torsional and compressive strength of the frame profile. Alternatively, an embodiment of the game racket may comprise elongated string hole openings without compromising the torsional stability and bending resistance of the frame profile.

In other embodiments of the present invention, the game racket frame may comprise staggered, pre-formed string channels as an option to avoid string hole drilling and to improve the strength of the racket frame.

The above and other objects may be achieved using devices involving a composite game racket frame comprising a handle, a throat member comprising a first and second throat arm wherein the throat arm is coupled to the handle, a bridge port on coupled to the throat member near the first and second throat arms, and a head frame coupled to the throat member near the first and second throat arms. The head frame further comprises a first, second, and at least a third generally tubular component which is aligned such that the second tubular component is between the first and third tubular components.

The above and other objects may be achieved using devices wherein the racket further comprises a first common bonding wall between the first and second components.

The above and other objects may be achieved using devices wherein the racket further comprises a second common bonding wall between the second and at least third components, and at least one drilled outside string hole on an outward facing surface of the second component between the first and second common bonding walls.

The above and other objects may be achieved using devices wherein the racket further comprises at least on drilled inside string hole on an inward facing surface of the second component between the first and second common bonding walls.

The above and other objects may be achieved using devices wherein the racket further comprises a grommet configured to fit within the at least one drilled inside string hole and the at least one drilled outside string hole.

The above and other objects may be achieved using devices wherein the racket further comprises a machined elongated string channel opening on an inward facing portion of the second component and between the first and second common bonding wall.

The above and other objects may be achieved using devices wherein the racket further comprises a grommet configured to fit within the at least one drilled outside string hole.

The above and other objects may be achieved using devices wherein the first and second common bonding walls are substantially The above and other objects may be achieved using devices wherein the common bonding walls are unparallel.

The above and other objects may be achieved using devices wherein the racket further comprises at least one drilled inside string hole on an inward facing surface of the second component between the first and second common bonding walls.

The above and other objects may be achieved using devices wherein the racket further comprises a standard grommet configured to fit within the at least one drilled inside string hole and the at least one drilled outside string hole.

The above and other objects may be achieved using devices wherein the racket further comprises a machined elongated string channel opening on an inward facing portion of the second component and between the first and the second common bonding wall.

The above and other objects may be achieved using devices wherein the racket further comprises a short grommet configured to fit with the at least one drilled outside string hole.

The above and other objects may be achieved using devices wherein the second tubular component comprises a pre-formed component.

The above and other objects may be achieved using devices wherein the pre-formed component comprises at least one pre-formed string hole opening.

The above and other objects may be achieved using devices wherein the at least one pre-formed string hole opening comprises at least two pre-formed string hole openings, the locations of which alternate between the first and second tabular components, and the second and third tubular components.

The above and other objects may be achieved using devices wherein the pre-formed component comprises at least one (pre-formed elongated string channel opening.

The above and other objects may be achieved using devices involving a composite game racket frame comprising a handle, and a throat member comprising a first and a second throat arm, wherein the throat member is coupled to the handle. The devices may further comprise a bridge portion coupled to the throat member at the first and second arms, and a head frame coupled to the throat member at the first and second arms. The head frame further comprises at least two generally tubular side components and at least two central components aligned such that the at least two central components are between the at least two generally tubular side components.

The above and other objects may be achieved using devices wherein the racket further comprises common side bonding walls between each of the at least two side components and the at least two central components, a central common bonding wall between the at least two central components, and at least one drilled string hole in the central component.

The above and other objects may be achieved using devices wherein the racket further comprises a standard grommet configured to fit within the at least one drilled string hole in the central component.

The above and other objects may be achieved using devices wherein the racket further comprises at least one pre-formed string hole opening between the at least two central components.

The above and other objects may be achieved using methods of assembling a composite game racket frame involving wrapping a first and at least a second bladder with composite pre-preg material, placing the first bladder in a mold cavity shaped as the game racket, placing a pre-formed element in the mold cavity above the first bladder placing the at least second bladder in the mold cavity above the pre-formed element, closing the mold cavity, pressurizing the bladders and heating the mold cavity until the pre-prep material is fully cured, opening the mold, removing secondary mold cavity members from mold cavity, and removing the racket frame from the mold cavity. In some implementations any number of secondary mold cavity members may be placed in the mold cavity. The above and other objects may be achieved using methods further comprising, securing a first intermediate mold cavity member in place above the first bladder.

The above and other objects may be achieved using methods further comprising placing at least a first spacer between the first bladder and the pre-formed element before closing the mold cavity, and placing at least a second spacer on the pre-formed element before placing at least the second bladder in the mold cavity.

The above and other objects may be achieved using methods wherein the pre-formed element comprises a pre-formed string channel opening on either an outward or inward facing surface or both.

The above and other objects may be achieved using methods further comprising drilling at least on string hole opening through the pre-formed element.

The above and other objects may be achieved using methods further comprising cutting at least one elongated string channel opening on an inward facing surface.

The above and other objects may be achieved using methods of assembling a game racket involving wrapping a first, a second, and at least a third bladder with composite pre-preg material, placing the first bladder in the mold cavity, securing a first secondary mold cavity member, placing the second bladder in the mold cavity, placing at least the third bladder in the mold cavity, closing the mold cavity, pressurizing the bladders and heating the mold until the pre-preg material is fully cured, and removing the racket frame from the mold cavity.

The above and other objects may be achieved using methods further comprising placing at least a first spacer between the first bladder and the second bladder before closing the mold cavity, and placing at least a second spacer between the second bladder and at least the third bladder before closing.

The above and other objects may be achieved using methods further comprising securing a first intermediate mold cavity member above the first bladder, and securing at least a second intermediate mold cavity member abot the second bladder.

The above and other objects may be achieved using methods further comprising drilling at least one string hole opening through the pre-formed element.

The above and other objects may be achieved using methods further comprising cutting at least one elongated string channel opening on an inward facing surface.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for, and will also recite the word "function" (i.e., will state "means for" performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Embodiments of the present invention recognize that the superior strength of a frame profile with, for example, two common bonding watts or three components, can allow for improvement and softening of the racket performance in other ways that would be unattainable with a conventional doable bladder method. Embodiments of the present invention enable flexibility in the distribution of weight and strength attributed to the common waits by allowing one portion of the frame to have a different number of components than another part. The superior compressive and torsional strength of the multi-wall construction of the present invention allows for the softening of the frame and string response in other, more critical areas.

The present embodiment may comprise elongated openings on an inside surface of the racket profile. In a conventional single bladder frame, machined string channel openings cannot be provided without compromising the structural integrity of the racket. In a two bladder frame, one of the objectives is to avoid machining altogether. Embodiments of the present invention seek to make a better performing, more stable racket frame with an increased effective string length possible by use of common machining methods. The multi-bladder, strong design according to various embodiments of the present invention includes at least two common bonding walls, and therefore a machined elongated string channel opening can be provided without compromising the structural integrity of the racket. The additional weight added by the common bonding walls may be offset by the removal of significant amounts of material when an elongated opening is cut from the profile.

Figure 1:
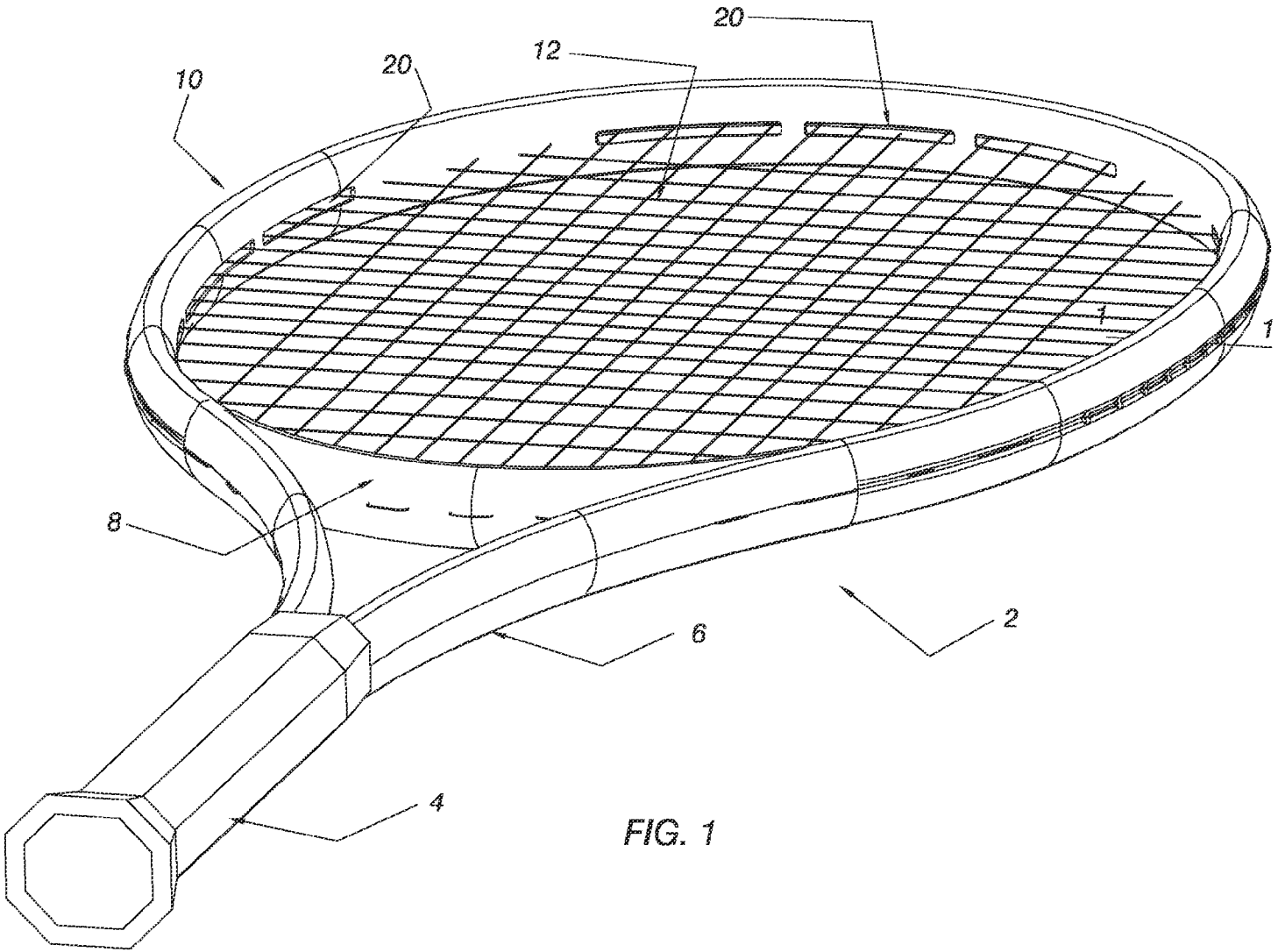
FIG. 1 depicts a 3-dimensional view of a game racket including an implementation of the present invention.

Referring now to FIG. 1, a game racket 2 according to various embodiments of the present invention is shown. In the present embodiment the game racket comprises a handle 4, a head frame 10, a throat member 6 connecting the handle 4 to the head frame 10, a bridge member 8, and a stringed hitting surface 12. The present embodiment further comprises a sequence of machined elongated string channel openings 20 at a number of strategic locations on the periphery of the stringed surface 12 at the head frame 10 and the bridge member 8. In various embodiments, the elongated string channel openings may either be machined elongated string channel openings 20 as shown here, or pre-formed elongated string channel openings 22 as be described in subsequent embodiments. Machined 20 or pre-formed string channel openings 22 may be found at any location on the head frame 10 or the bridge member 8. In an embodiment, pre-formed elongated string channel openings 22 are present on the head frame 10 at a top portion that is approximately opposite the bridge member 8 and two side portions that are approximately opposite from each other. In other embodiments, more or less elongated string channel openings are present on these or other portions of the head frame 10 or bridge member 8. For example, it would be advantageous to locate elongated string channel openings 20, in the areas of the stringed surface that are between the top and side portions of the head frame 10 and also in the areas between the bridge member 8 and the side portions.

Figure 2:
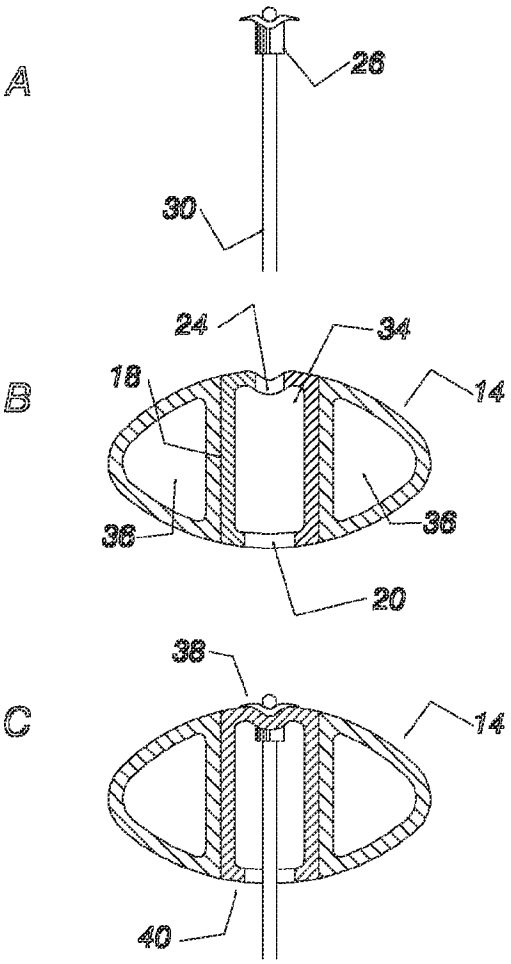
FIGS. 2A-C show various cross-section views of the head frame of the game racket.

Referring now to FIG. 2, a cross-sectioned view along line 1-1 in FIG. 1, through the head frame 10 of a strong game racket 2 according to various applications of the present invention is shown. FIG. 2A depicts a string 30 and short grommet 26 separate from a frame profile 14 FIG. 2B depicts a frame profile 14 without the string 30 and short grommet 26. FIG. 2C depicts a frame profile 14 with the string 30 and short grommet 26 in a string hole 24.

Referring to FIG. 2B, the head frame 10 may comprise any number of components to give maximum strength and stability to the racket while still providing necessary flexibility in the distribution of weight attributed to common walls. In the present embodiment, the frame profile 14 comprises three components: a center component 34 and two side components 36. The center component 34 is centered on the axis of the stringed hitting surface 12, while the two side components 36 are on opposite sides of the center component, forming at least two common bonding walls 18. A common bonding wall 18 is created at any point where any components meet, whether ether center component 34 or side component 36.

The frame profile 14 may further comprise internal ribs or any other apparatus for improving torsional stability of the racket 2 as well as improving compressive strength along the frame profile's 14 short axis, which is in-line with the axis of a string 30. In the present embodiment internal ribs or common bonding walls 18 provide this improved torsional stability. The frame profile 14 may further comprise any opening that allows the string 30 to be laced through such as a drilled hole 24, a pre-formed string channel opening 54 as shown in subsequent embodiments, or an elongated string channel opening. In the embodiment depicted in FIG. 2, a string 30 is laced through a drilled hole 24 on any outside facing surface 38 of the frame profile 14 and passes through an elongated opening on an inside facing surface 40 of the profile 14. The elongated opening 20 on the inside facing surface 40 may be created by a variety of methods, such as machined, pre-formed, or the like. In the present embodiment, the elongated string channel opening is a machined elongated string channel opening 20. The machined elongated string channel 20 opening is created by drilling, machining, or any combination thereof that achieves an elongated opening on the inside facing surface 40 of the head frame 10 that allows for an increased effective string length. Because the string only contacts or bears on the outside facing surface 38, a short grommet 26 can be used, thus reducing the overall weight of the racket 2 while still protecting the string 30.

In other embodiments, a cross-sectioned view of the bridge member 8 would have substantially identical characteristics to the head frame 10 cross section depicted in FIG. 2A-C.

Figure 3:
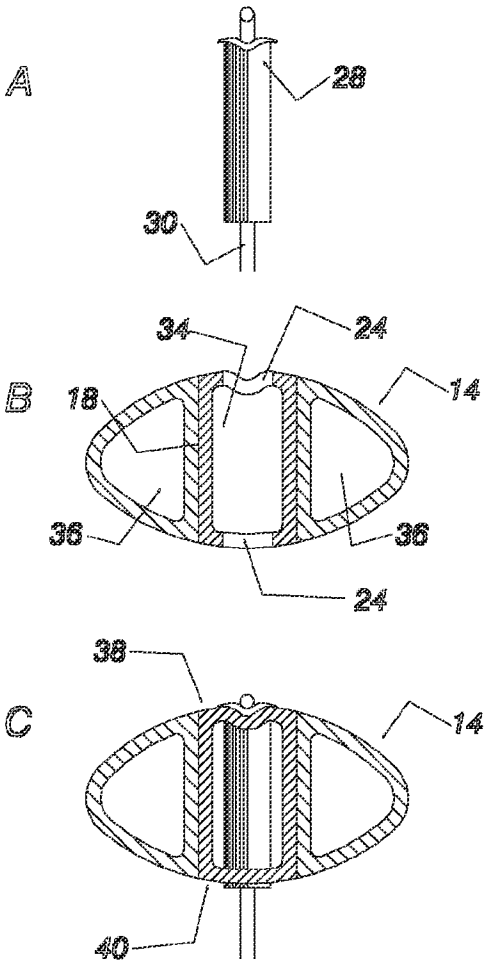
FIGS. 3A-C show some alternative cross-section views of the head frame of the game racket.

Referring now to FIG. 3A-C, a cross-sectioned view along line 1-1 in FIG. 1, of the head frame 10 according to various aspects of the present invention is depicted. FIG. 3A depicts a string 30 and standard grommet 28 separate from the frame profile 14. FIG. 3B depicts a frame profile 14 without the string 30 and standard grommet 28. FIG. 3C depicts a frame profile 14 with the string 30 and standard grommet 28 in a string hole 24.

Referring to FIG. 3B, the frame profile 14 may comprise any number of components to give maximum strength and stability to the racket while still providing necessary flexibility in the distribution of weight attributed to common walls 18. In the present embodiment, the frame profile 14 comprises three components: a center component 34 and two side components 36. The center component 34 is centered on the axis of the stringed hitting surface 12, while the two side components 36 are on apposite sides of the center component, forming at least two common bonding walls 18. A common bonding wall 18 is created at any point where any components meet, whether center component 34 or side component 36.

The frame profile 14 may further comprise internal ribs or any apparatus for improving torsional stability of the racket 2 as well as improving compressive strength along the frame profile's 14 short axis, which is in-line with the axis of a string 30. The frame profile 14 may further comprise any opening that allows the string 30 to be laced through, such as a drilled hole 24, a pre-formed opening, or an elongated string channel opening. In the embodiment depicted in FIG. 3C, a string 30 is laced through a drilled string hole 24 on both the inside facing surface 40 and the outside facing surface 38 of the head frame 10. The design of the present embodiment allows the drilled hole to be larger than is customary in similar rackets, thereby allowing a greater range of string movement. Because the drilled hole passes entirely through the head frame 10, a standard full-length grommet 28 may be used to protect the string. This embodiment may be beneficial for use on areas of the racket that would not permit the use of elongated openings, such as a location of a string knot.

In other embodiments, a cross-sectioned view of the bridge member 8 would have substantially identical characteristics to the head frame 10 cross-section depicted in FIG. 3A-C.

Figure 4:
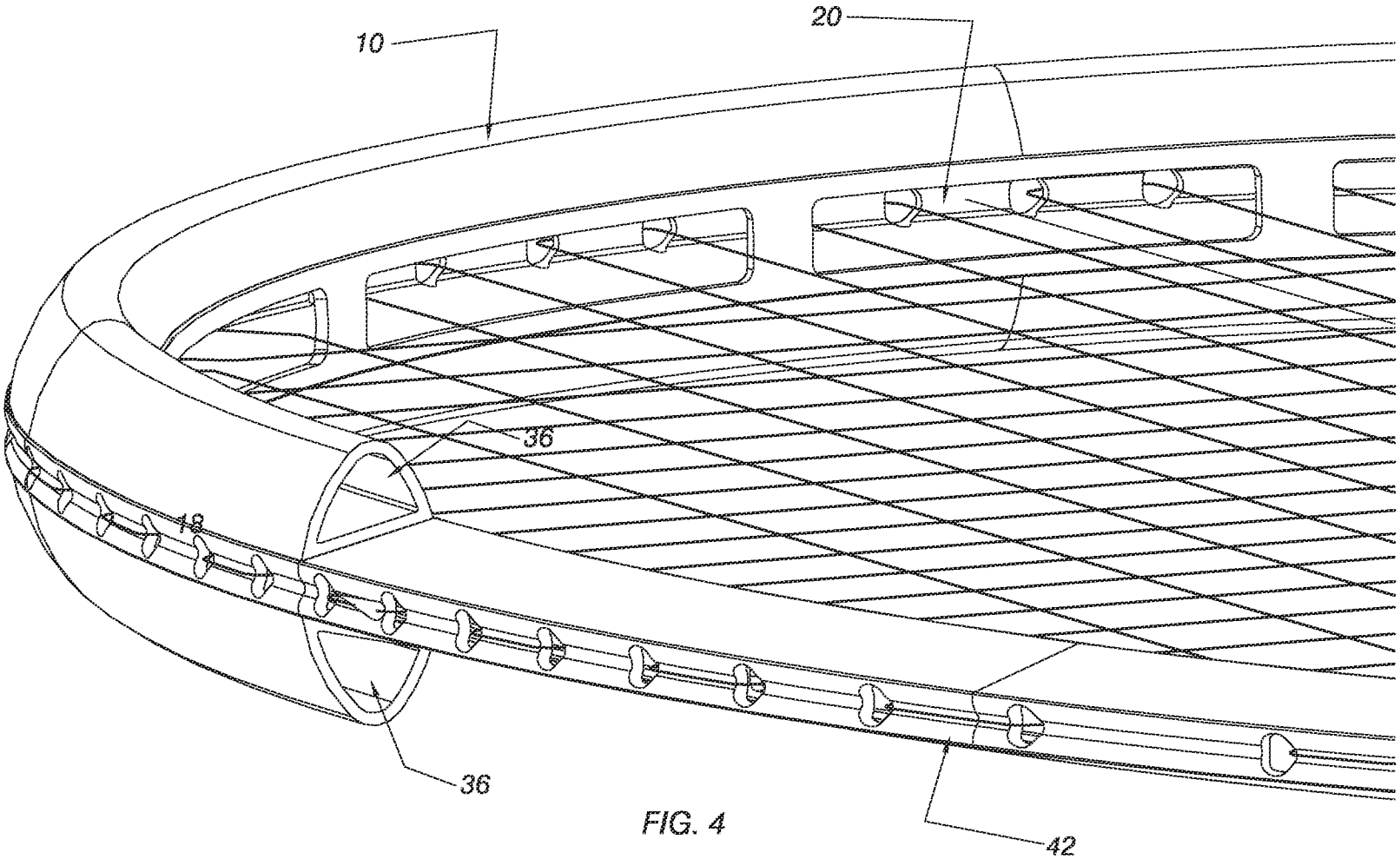
FIG. 4 depicts a three-dimensional cross-sectional view of a possible embodiment of the invention.

Referring now to FIG. 4, a 3 dimensional view of an embodiment of the game racket 2 according to various aspects of the present invention is depicted. In the present embodiment, the head frame 10 profile comprises three components: a center trapezoidal-like component 42 and two side components 36. The center trapezoidal-like component 42 comprises any similar shaped component to provide greater strength to the profile of the game racket 2 by making the head frame 10 unyielding to the compressive force of string tension and bending forces due to use. This particular trapezoidal-like component also allows the string a far greater swing range as it responds to object impact. The center-trapezoidal-like component 42 may be pre-formed, as it is in the present embodiment, or formed during the molding process. The center trapezoidal-like component 42 may comprise any shape that creates unparallel common bonding walls 18. If the central trapezoidal-like component 42 is pre-formed, it may in some embodiments further comprise two components, thus providing a pre-formed string channel opening 54. In various embodiments, the center trapezoidal-like component 42 may be in both the head frame 10 and the bridge member 8. In an embodiment, the center trapezoidal-like component comprises one continuous piece around the entire head frame 10 periphery and therefore also forms a bridge member 8 of the head frame 10.

Referring now to FIG. 4, the side components 36 are shown as a partial cross-section to view the center trapezoidal-like component 42 and the common bonding walls 18. Specific locations on the racquet may require more or less strength than others and therefore the present embodiment allows for strength distribution in the racket by controlling the number of common bonding walls 18 formed in each particular location. Controlling the strength distributed with internal common bonding walls 18 also allows for control of the weight distribution as well. In an embodiment, a head frame 10 profile requires far more torsional stability than a profile at the bridge member 8 or throat member 6. Therefore, an embodiment of the present invention may comprise a head frame 10 formed with three components, a bridge member 8 formed with one component, and a throat member 6 formed of two components. In other embodiments, varying combinations of any number of components in each of the bridge member 8, throat member 6, and head frame 10 may be used. For example, in yet another embodiment, a head frame 10 profile of four generally tubular components may be used; two of the four generally tubular components may form the bridge member 8, while the other two generally tubular components may form the throat member 6.

FIG. 4 further depicts a continuous sequence of elongated channel openings around the entire head frame 10. In the present embodiment, the elongated channel openings are machined elongated channel openings 20. In other embodiments, the center trapezoidal-like component may be used in combination with pre-formed elongated string channel openings 22. In still other embodiments, the sequencing of either pre-formed elongated string channel openings 22 or machined elongated string channel openings 20 may not be continuous, and may be placed at any number of locations around the inside facing surface 40 of the head frame 10 or bridge member 8.

Figure 5:
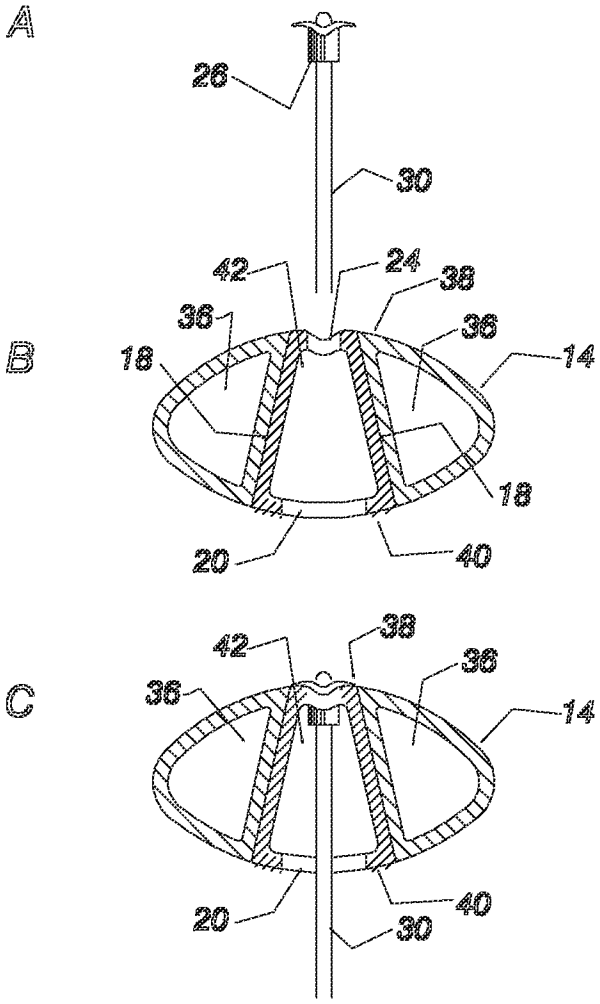
FIGS. 5A-C show a cross-sectional view of an alternative embodiment of the game racket head frame.

Referring now to FIG. 5A-C cross-sectioned view of the head frame 10 profile shown in FIG. 4. In the present embodiment, the frame profile 14 comprises three components and two internal ribs or common bonding walls 18. The three components present in this embodiment are two side components 36 and a center trapezoidal-like component 42. The embodiment depicted in FIG. 5 comprises a machined elongated string channel opening 20 on an inside facing surface 40, and a drilled string hole 24, on the outside facing surface 38 of the head frame 10 or bridge member 8 profile, through which a string 30 may be looped.

Figure 6:
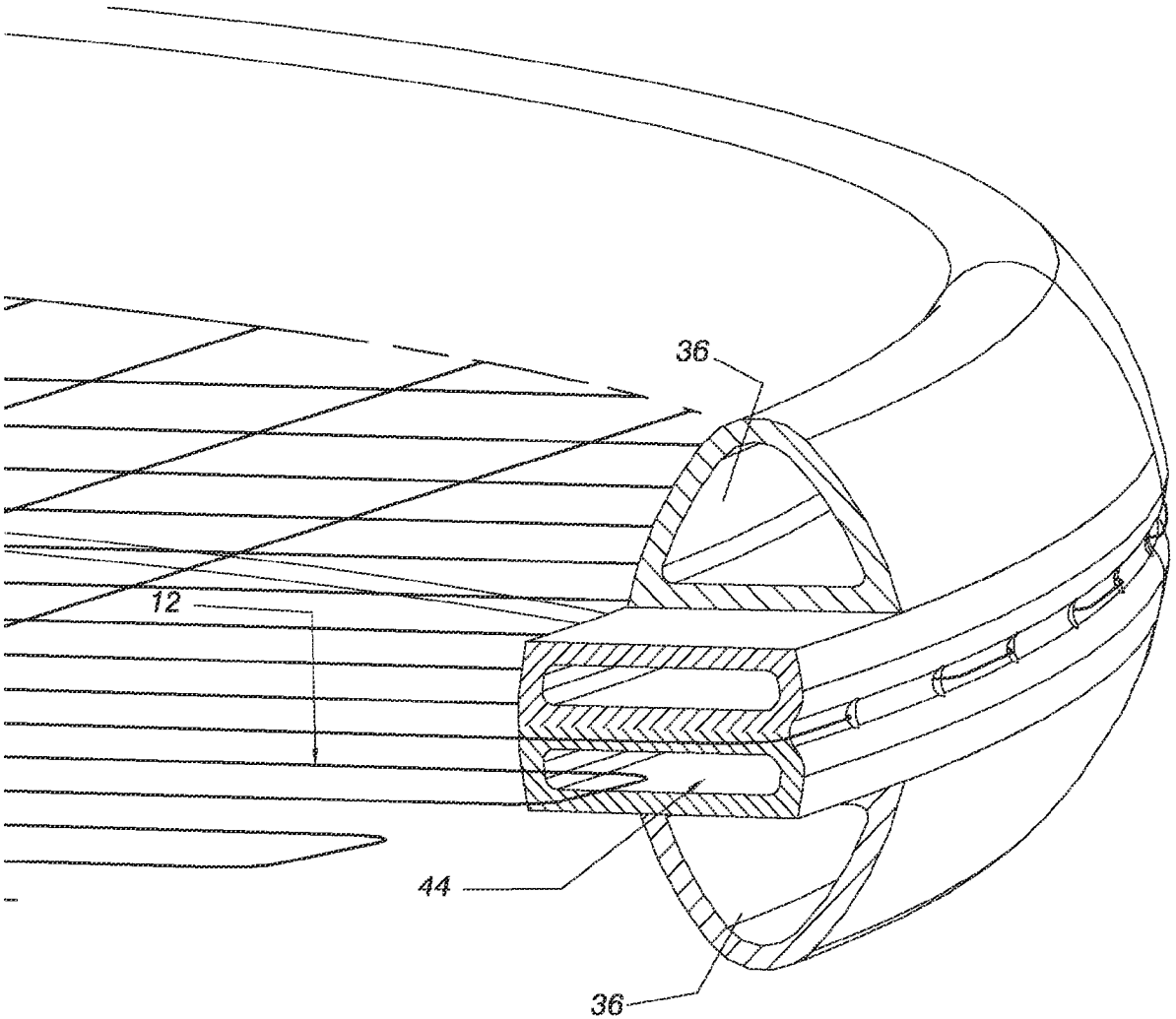
FIG. 6 depicts a three-dimensional cross-sectional view of a possible embodiment of the invention.

Referring now to FIG. 6, a partial cross-sectioned 3 dimensional view of the head frame 10 profile according to another embodiment of the present invention. In this embodiment, the frame profile 14 comprises at least four components. In addition to the two side components 36, the frame profile 14 further comprises a doubled-central component 44. The doubled-central component 44 is comprised of two components joined together to form another common bonding wall 18. In an embodiment, the two components of the doubled-central component 44 may be approximately symmetrical about the axis that is the stringed playing surface 12. The two components that comprise the doubled-central component 44 may be either pre-formed prior to molding or formed during the molding process. In the present embodiment, the doubled-central component is pre-formed prior to molding together with the side components 36. Pre-forming the doubled-central component 44 allows for the pre-forming of string channel openings of various kinds between the common walls of the components such as pre-formed elongated openings, a machined elongated opening, typical single-string openings, doable-string openings, and the like. In the present embodiment, the doubled-central component 44 comprises a pre-formed elongated string channel opening 22. The presence of pre-formed string channel openings may eliminate the need for grommets and reduce the overall weight of the racket.

Figure 7:
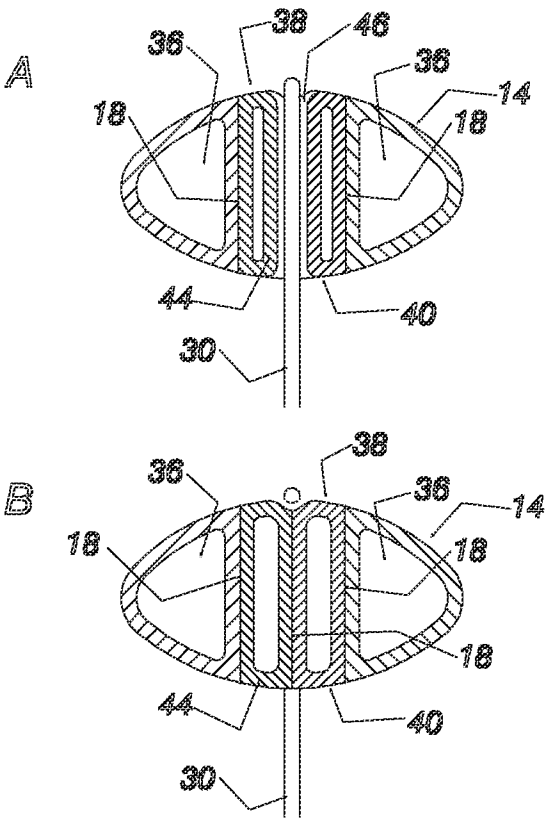
FIGS. 7A-B show a cross-sectional view of an alternative embodiment of the game racket head frame.
Figure 8:
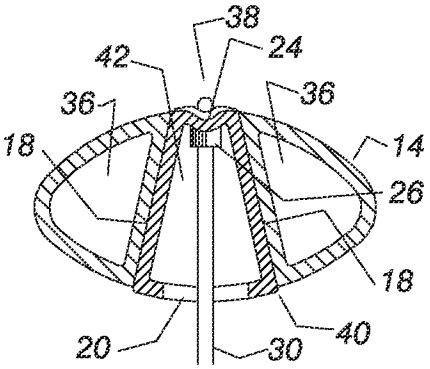
FIGS. 8-13 show various cross-sectional views of various alternative embodiments of the game racket head frame.

Referring now to FIG. 7, a cross-sectioned view of the embodiment shown in FIG. 6. FIG. 7A depicts a frame profile 14, cut through a head frame 10, with a string 30 laced through a pre-formed string channel opening 54. FIG. 7B depicts a frame profile 14 in between openings 54 and showing a common bonding wall 18 at the doubled central component 44. In this embodiment, the string 30 runs through the pre-formed string channel opening 54 between the two components that comprise the doubled-central component 44. Side components 36 are on outside facing walls of the doubled-central component 44 and form two common bonding walls 18 with the doubled-central component 44. In addition to the common bonding walls 18 formed between the side components 36 and the doubled-central component 44, FIGS. 7A-B also depict the common bonding wall 18 formed by the two components of the doubled-central component 44 itself.

Referring now to FIGS. 8-13, which depict cross sections of various applications of the invention. In an embodiment depicted in FIG. 8, the exposed outer surface of the central component 34 protrudes out beyond the exposed outer surface of the adjacent components. In another embodiment, the protrusions of the central component 34 may be more or less than those shown in FIG. 8. This embodiment may further comprise any multi-component profile for greatly improving the moment of inertia of the profile and therefore further ensuring the complete stability of the racket frame under stress from ball impact. In the present embodiment, the central component 34 forms a strong a resistive force to the torsion brought by ball impact. This differentation of surfaces is a unique capacity that the method of the present invention allows due to the multiple bladder molding technique.

Figure 9:
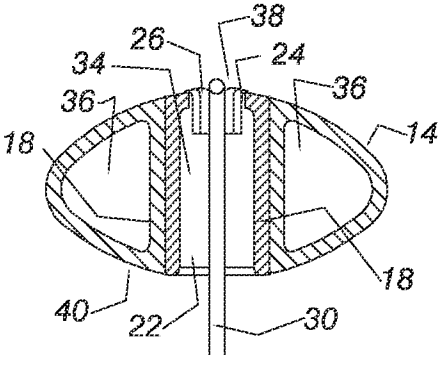

In FIG. 9, a cross section of either the head frame 10 or bridge member 8 is shown with a (pre-formed elongated string channel opening 22 on an inside facing surface 40 and a drilled string hole opening 24 on the outside facing surface 38 of the profile 14. Because the string 30 is laced through a drilled hole opening 24 on the outside of the profile, a shortened grommet 26 may be used to protect the string.

Figure 10:
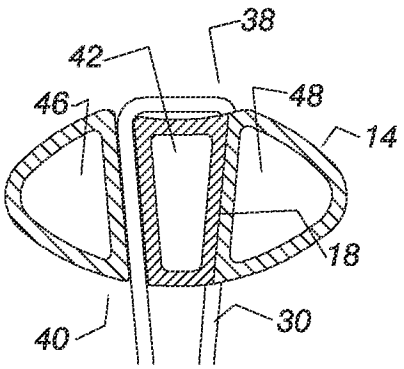
Figure 11:
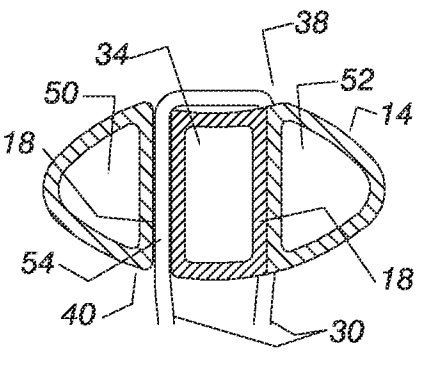

In FIGS. 10-11, cross sections of applications of the invention with staggered string channel openings in either the head frame 10 or bridge member 8 profile are shown. In FIG. 10, string channel openings are staggered throughout the trapezoidal-like central component 42. In this embodiment, the string channel openings are formed between the bonding watts of the trapezoidal-like central component 42 and either the first side component 46 or the second side component 48. The staggering of the string channels occurs at least once on the head frame 10 or bridge member 8. The string channel openings alternate from being between the bonding wall of the first side component 46 and the trapezoidal-like central component 42 to being between the bonding wall of the second side component 48 and the trapezoidal-like central component 42. In the present embodiment, the string openings alternate side-to-side after each string channel opening; in other embodiments, the string channel opening may alternate after any number string channel openings.

In FIG. 11, string channel openings are staggered throughout the center component 34. In this embodiment, the string channel openings 54 are formed between the bonding walls of the center component 34 and either the first side component 50 or the second side component 52. The staggering of the string channels occurs at least once on the head frame 10 or bridge member 8. The string channel openings 54 alternate from being between the bonding wall 18 of the first side component 50 and the center component 34 to being between the bonding wall 18 of the second side component 52 and the center component 34. In the present embodiment, the string openings alternate side-to-side after each string channel opening; in other embodiments, the string channel opening may alternate after any number of string channel openings.

Figure 12:
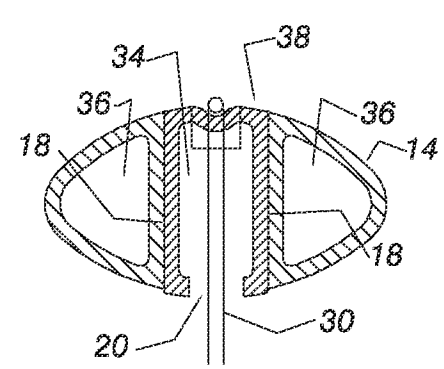

In FIG. 12, a cross section of a frame profile 14, either the head frame or bridge member, is shown with a machined elongated string channel opening 20 on an inside facing surface 40 and a drilled string hole opening 24 on the outside facing surface 38 of the profile 14. Because the string 30 is laced through a drilled hole opening 24 on the outside of the profile 14, a shortened grommet 26 may be used to protect the string 30. The three components present in this embodiment are two side components 36 and a center trapezoidal-like component 42. The center trapezoidal-like component 42 may protrude past the outer surfaces of the adjacent components. It may also be that the component 44 may be recessed in such a way as to make a groove on either an inside facing surface 40 of a profile 14 or on an outside facing surface 38 or both. In an alternative embodiment, the machined elongated string channel opening 20 may be replaced with a pre-formed elongated string channel opening 22.

Figure 13:
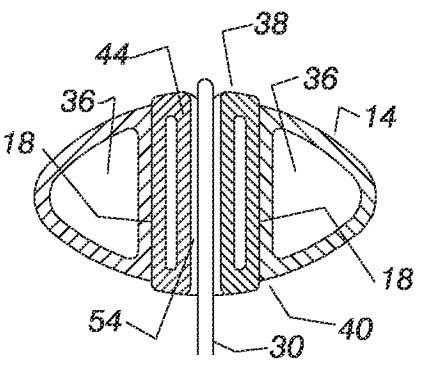

In FIG. 13, a cross section of either the head frame 10 or bridge member 8 is shown with a pre-formed elongated string channel opening 54. In this embodiment, the string 30 runs through the pre-formed string channel opening 54, between the two components that comprise the doubled-central component 44. Side components 36 are on outside facing walls of the doubled-central component 44 and form two common bonding walls with the doubled-central component 44. In addition to the common bonding walls 18 formed between the side components 36 and the doubled-central component 44, FIGS. 7A-B also depict the common bonding wall 18 formed by the two components of the doubled-central component 44 itself. The doubled-central component 44 may protrude past the outer surfaces of the adjacent components.

In any embodiment shown in FIGS. 1-13 it is possible for the central component to protrude past the side components or be recessed from the side components. Alternatively the component 44 may be recessed in such a way as to make a groove on either an inside facing surface 40 of a profile 14 or on an outside facing surface 38 or both.

Figure 14:
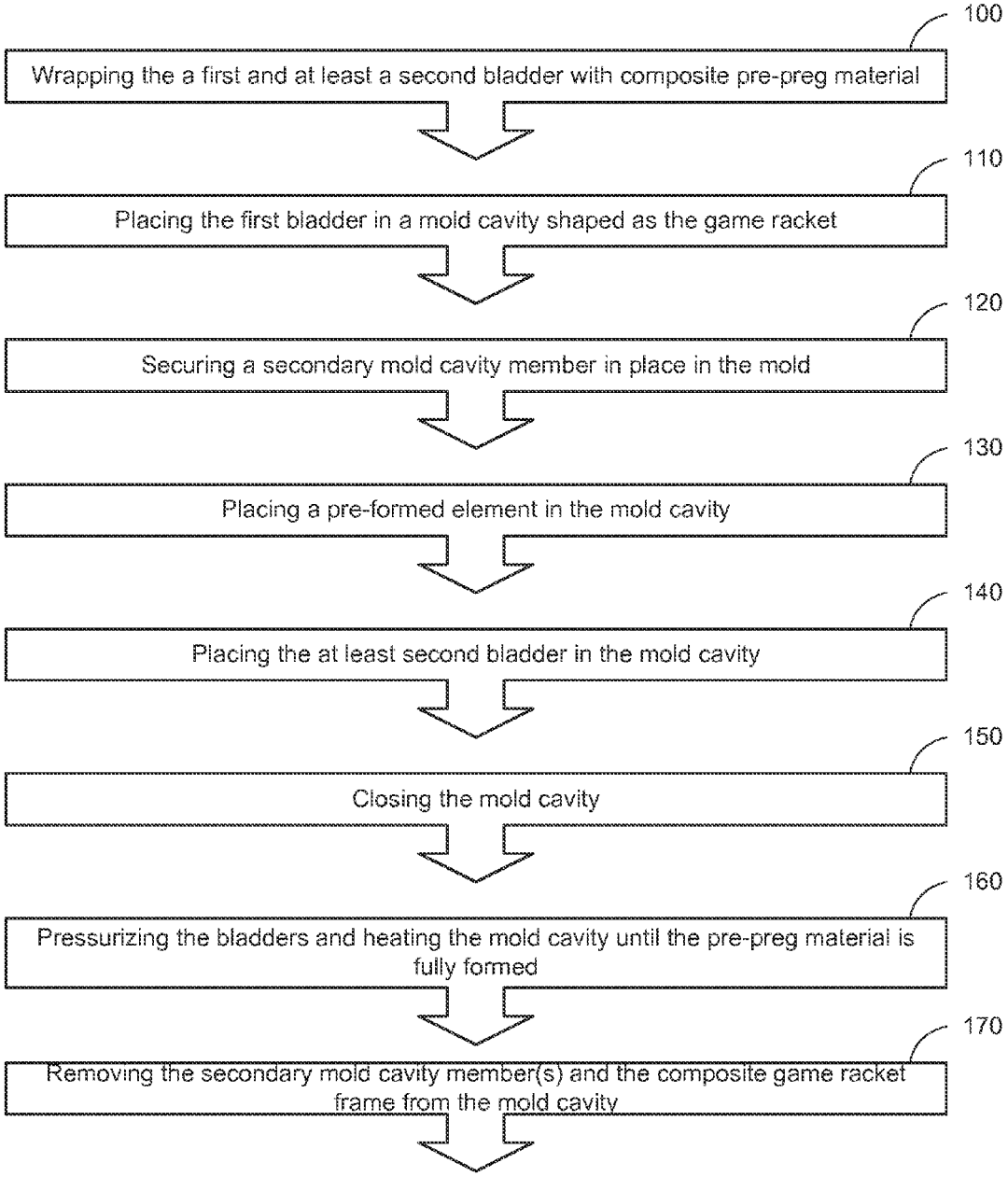
FIG. 14 depicts an example method of making a composite game racket.
Figure 15:
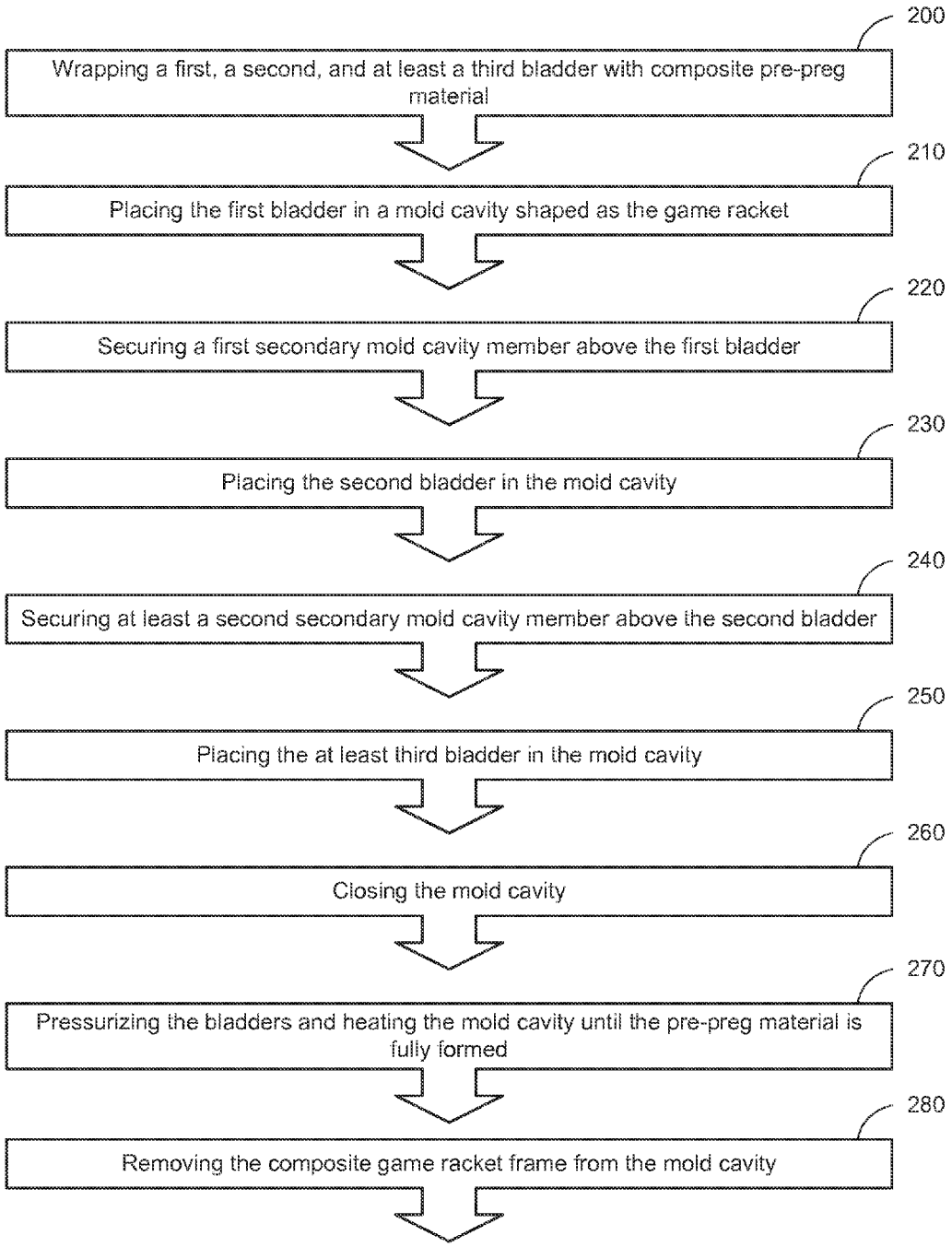
FIG. 15 depicts an alternate exemplary method of making a composite game racket.

Referring now to FIG. 14, a flowchart depicting a method of assembling a composite game racket frame. In various embodiments, the method may comprise wrapping a plurality of bladders with composite pre-preg material 100. In a particular implementation, the method may comprise wrapping a first and at least a second bladder with composite pre-preg material 100. Other implementations may comprise a first, second, and at least a third bladder with composite pre-preg material 200 as seen in FIG. 15. In an embodiment, the method may then comprise placing the first bladder in a mold cavity shaped as a game racket 110. The first bladder may be placed in the mold cavity either by hand or by any instrument known in the art.

In alternate embodiments, the method may then comprise securing a first intermediate mold cavity member in a location in the mold cavity. Any number of instruments or methods may be utilized to secure the first intermediate cavity member. The method may then comprise placing a pre-formed element in the mold cavity 130 above the first bladder 120. The pre-formed element may be placed in the mold cavity either by hand or by any of a variety of instruments. In various implementations, the pre-formed element may comprise any variety of pre-formed elements, including but not fir cited to an elongated string channel opening, a string channel opening, and a string hole opening.

The method may then comprise placing at least a second bladder in the mold cavity 140 above the pre-formed element. In an alternative embodiment, this may then be followed by securing more secondary intermediate mold members into place in the cavity. Once these actions are completed, the method may comprise closing the mold cavity 150. In other implementations, additional actions may be taken before closing the mold cavity. For example and not by way of limitation, in an implementation, the method may also comprise placing at least a first spacer between the first bladder and the pre-formed element. Various implementations may also comprise placing at least a second spacer on the pre-formed element before placing at least the second bladder the old cavity. Ire an implementation comprising three bladders, a first spacer may placed at any time between the first bladder and second bladder, and a second spacer may between the second bladder and the third bladder. Any number of first spacers may be placed between the first and second bladders, and any number of second spacers may be placed between the second and third bladders.

Once the mold cavity is closed, the method may comprise pressurizing the bladders and heating the mold until the pre-preg material is fully cured 160. Once the pre-preg material is cured, the method may comprise removing the racket frame from the mold 170. Various implementations will include removing secondary mold members or spacers or pins, etc. as part of the removal of the racket from the mold. Various implementations of the method may also comprise placing a string hole opening through any part of the game racket and any time during the method, such as but not limited to drilling at least one string hole opening through the pre-formed element. In some embodiments, the method may further comprise creating an opening through any part of the racket at any time during the method, including but not limited to cutting at least one elongated string channel opening on an inward facing surface. In other implementations, any number of openings, including a plurality of elongated string channel openings may be out into the inward facing surface of the game racket.

Referring now to FIG. 15, a flowchart depicting a possible alternative method of assembling a composite game racket frame. In various embodiments, the method may comprise wrapping a plurality of bladders with composite pre-preg material 200. In a particular implementation, the method may comprise wrapping a first, a second, and at least a third bladder with composite pre-preg material 200. In an embodiment, the method may then comprise placing the first bladder in a mold cavity shaped as a game racket 210. The first bladder may be placed in the mold cavity either by hand or by any instrument known in the art.

The method may then comprise placing a pre-formed element or a first intermediate mold cavity member in the mold cavity above or around the first bladder 220. The pre-formed element may be placed in the mold cavity either by hand or by any of a variety of instruments. In various implementations, the pre-formed element may comprise any variety of pre-formed elements, including but not limited to an elongated string channel opening. Any number of instruments or methods may be utilized to secure the first secondary mold cavity member. The method may then comprise placing the second bladder in the mold cavity 230. The method may then comprise securing at least a second intermediate mold cavity member in place in the mold cavity 240, followed by placing the at least third bladder in the mold cavity 250. Once these actions are completed, the method may comprise closing the mold cavity 260. In other implementations, additional actions may be taken before closing the mold cavity. For example and not by way of limitation, the method may also comprise placing a first spacer at any time between the first bladder and second bladder, and placing a second spacer between the second bladder and the third bladder. Any number of first spacers may be placed between the first and second bladders, and any number of second spacers may be placed between the second and third bladders.

Once the mold cavity is closed, the method may comprise pressurizing the bladders and heating the mold until the pre-preg material is fully cured 270. Once the pre-preg material is cured, the method may comprise removing the racket frame from the mold 280. Various implementations will include removing secondary mold members or spacers or pins, etc. as part of the removal of the racket from the mold. Various implementations of the method may also comprise placing a string hole opening through any part of the game racket and any time during the method, such as but not limited to drilling at least one string hole opening through the pre-formed element. In some embodiments, the method may further comprise creating an opening through any part of the racket at any time during the method, including but not limited to cutting at least one elongated string channel opening on an inward facing surface. In other implementations, any number of openings, including a plurality of elongated string channel openings may be cut into the inward facing surface of the game racket.

I claim:

1. A composite game racket frame, comprising: a handle;

a throat member comprising a first throat arm and second throat arm, the throat member coupled to the handle;

a bridge portion coupled to the throat member at the first and second arms; and a head frame coupled to the throat member at the first and second arms, comprising:

a first, a second, and at least a third generally tubular component, at least the second generally tubular component being preformed, the first, the second and the at least third generally tubular components aligned such that the second preformed component is between the first and the at least third components.

2. The racket according to claim 1, further comprising: a first common bonding wall between the first and second preformed components;

a second common bonding wall between the second and at least third preformed components; and at least one drilled outside string hole on an outward facing surface of the second preformed component between the first and second common bonding walls.

3. The racket according to claim 2, further comprising at least one drilled inside string hole on an inward facing surface of the second preformed component between the first and second common bonding walls.

4. The racket according to claim 3, further comprising a grommet configured to fit within the at least one drilled inside string hole and the at least one drilled outside string hole.

5. The racket according to claim 2, further comprising a machined elongated string channel opening on an inward facing portion of the second preformed component and between the first and the second common bonding wall.

6. The racket according to claim 5, further comprising a grommet configured to fit within the at least one drilled outside string hole.

7. The racket according to claim 2, wherein first and second common bonding walls are substantially parallel.

8. The racket according to claim 2, wherein the common bonding walls configured to create a head frame and bridge member are unparallel.

9. The racket according to claim 8, further comprising at least drilled inside string hole on an inward facing surface of the second preformed component between the first and second common bonding walls.

10. The racket according to claim 9, further comprising a standard grommet configured to fit within the at least one drilled inside string hole and the at least one drilled outside string hole.

11. The racket according to claim 8, further comprising a machined elongated string channel opening on an inward facing portion of the second preformed component and between the first and the second common bonding wall.

12. The racket according to claim 11, further comprising a short grommet configured to fit within the at least one drilled outside string hole.

13. The racket according to claim 1, wherein the preformed component comprises at least one pre-formed string hole opening.

14. The racket according to claim 1, wherein the at least one pre-formed string hole opening comprises at least two pre-formed string hole openings, the locations of the at least two pre-formed string hole openings alternating between the first and second preformed components, and the second and third preformed components.

15. The racket according to claim 1, wherein the preformed component comprises at least one preformed elongated string channel opening.

16. A composite game racket frame, comprising: a handle;

a throat member comprising a first throat arm and second throat arm, the throat member coupled to the handle;

a bridge portion coupled to the throat member at the first arm and second arms; and a head frame coupled to the throat member at the first and second arms, comprising: at least two generally tubular side components and at least two central components aligned such that the at least two central components are between the at least two generally tubular side components.

17. The racket according to claim 16, further comprising:

common side bonding Walls between each of the at least two side components and the at least two central components;

a central common bonding wall between the at least two central components; and at least one drilled string hole in the central common bonding wall.

18. The racket according to claim 17, further comprising a standard grommet configured to fit within the at least one drilled string hole in the central common bonding wall.

19. The racket according to claim 16, further comprising at least one pre-formed string hole opening between the at least two central components.

* * * * *